US009707751B2

(12) United States Patent
Nishitani et al.

(10) Patent No.: US 9,707,751 B2
(45) Date of Patent: Jul. 18, 2017

(54) TRANSFER-TYPE INK JET RECORDING APPARATUS

(71) Applicant: CANON KABUSHIKI KAISHA, Tokyo (JP)

(72) Inventors: Eisuke Nishitani, Tokyo (JP); Takumi Otani, Kodaira (JP); Takayuki Sekine, Kawasaki (JP); Koichiro Nakazawa, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/183,491

(22) Filed: Jun. 15, 2016

(65) Prior Publication Data

US 2016/0375680 A1 Dec. 29, 2016

(30) Foreign Application Priority Data

Jun. 23, 2015 (JP) ..... 2015-125859

(51) Int. Cl.

| | |
|---|---|
| ***B41J 2/005*** | (2006.01) |
| ***G03G 15/16*** | (2006.01) |
| ***G03G 15/20*** | (2006.01) |
| ***G03G 15/10*** | (2006.01) |

(52) U.S. Cl.

CPC ..... *B41J 2/0057* (2013.01); *G03G 15/10* (2013.01); *G03G 15/161* (2013.01); *G03G 15/2021* (2013.01); *G03G 2215/1671* (2013.01); *G03G 2215/1695* (2013.01)

(58) Field of Classification Search

CPC B41J 2/0057; B41J 2002/012; B41J 11/0015; B41J 2/002; G03G 13/10; G03G 15/10; G03G 15/2021; G03G 15/161; G03G 2215/0119; G03G 2215/017; G03G 2215/1671; G03G 2215/168; G03G 2215/1685; G03G 2215/1695; G03G 9/00

See application file for complete search history.

(56) References Cited

U.S. PATENT DOCUMENTS

| | | | | |
|---|---|---|---|---|
| 6,420,080 | B1 * | 7/2002 | Nakamura | G03G 15/161 399/343 |
| 6,526,250 | B1 * | 2/2003 | Usui | G03G 15/161 399/307 |
| 6,585,354 | B2 | 7/2003 | Otani | |

(Continued)

FOREIGN PATENT DOCUMENTS

| | | |
|---|---|---|
| JP | 2008-221529 | 9/2008 |
| JP | 2013-142794 | 7/2013 |

*Primary Examiner* — Anh T. N. Vo

(74) *Attorney, Agent, or Firm* — Fitzpatrick, Cella, Harper & Scinto

(57) ABSTRACT

A transfer-type ink jet recording apparatus including an intermediate image forming unit for applying an ink containing a resin to an intermediate transfer member to form an intermediate image and a transfer unit for transferring the intermediate image to a recording medium. The apparatus further includes a heating unit for heating the intermediate image to a temperature equal to or higher than the minimum film forming temperature of the resin and a cooling unit for cooling the intermediate image heated by the heating unit to a temperature lower than the glass transition temperature of the resin to supply the image to the transfer unit.

10 Claims, 5 Drawing Sheets

(56) References Cited

U.S. PATENT DOCUMENTS

| | | | | |
|---|---|---|---|---|
| 6,716,562 | B2 * | 4/2004 | Uehara | B41J 2/0057 347/103 |
| 6,996,360 | B2 * | 2/2006 | Koga | G03G 15/169 399/296 |
| 7,048,356 | B2 | 5/2006 | Ishikawa et al. | |
| 7,226,157 | B2 | 6/2007 | Nakazawa et al. | |
| 7,533,954 | B2 | 5/2009 | Nakazawa et al. | |
| 7,661,786 | B2 | 2/2010 | Nakazawa et al. | |
| 7,661,809 | B2 * | 2/2010 | Taniuchi | B41J 2/0057 347/101 |
| 7,699,431 | B2 | 4/2010 | Nakazawa et al. | |
| 7,887,177 | B2 * | 2/2011 | Doi | B41J 2/0057 347/103 |
| 8,185,020 | B2 * | 5/2012 | Yoshie | G03G 15/11 399/249 |
| 8,573,768 | B2 * | 11/2013 | Onishi | B41J 2/0057 347/103 |
| 9,340,050 | B2 | 5/2016 | Otani et al. | |
| 9,415,602 | B2 | 8/2016 | Takeuchi et al. | |
| 2008/0218547 | A1 | 9/2008 | Takamiya et al. | |
| 2011/0298853 | A1 | 12/2011 | Takamiya et al. | |
| 2016/0303870 | A1 | 10/2016 | Moriguchi et al. | |

* cited by examiner

FIG. 1
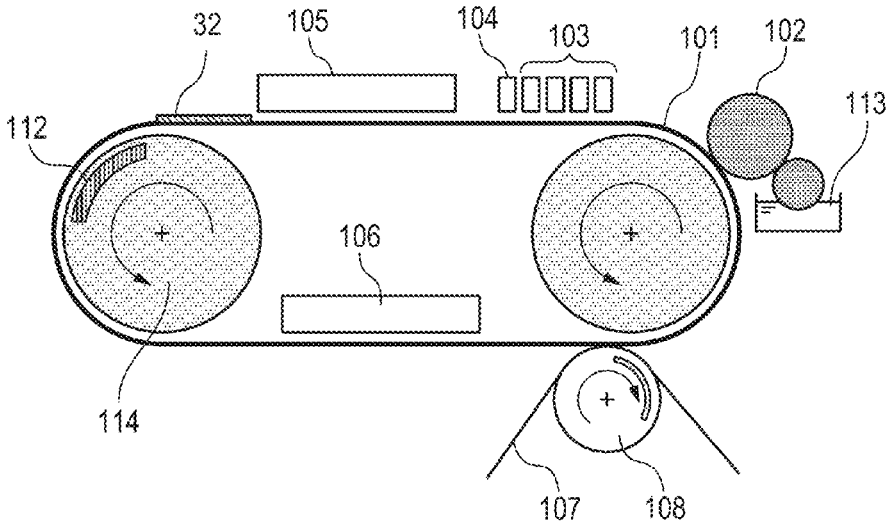
FIG. 2A1
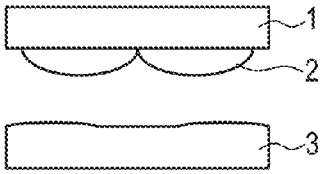
FIG. 2A2
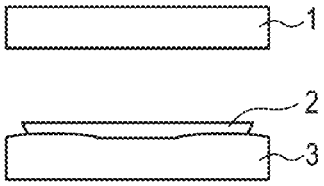
FIG. 2B1
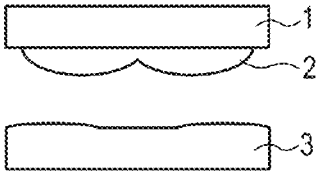
FIG. 2B2
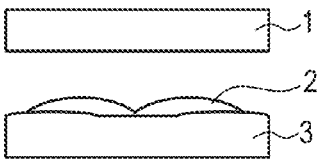

TRANSFER-TYPE INK JET RECORDING APPARATUS

BACKGROUND OF THE INVENTION

Field of the Invention

The present invention relates to a transfer-type ink jet recording apparatus.

Description of the Related Art

An ink jet recording apparatus has heretofore been widely used in, for example, computer-related output devices from the viewpoints of low running cost, possibility of miniaturizing an apparatus and ease of meeting color image recording with a plurality of color inks.

In recent years, there has been a demand for developing an apparatus capable of outputting a high-quality image at a high speed without depending on the kind of a recording medium. In order to achieve the output of the high-quality image at the high speed, it is necessary to inhibit an image degradation phenomenon such as feathering caused by ink permeation along fibers of a recording medium to disorder an image.

Japanese Patent Application Laid-Open No. 2008-221529 discloses a transfer-type ink jet recording apparatus using an intermediate transfer member as a means for solving the above problem. In the transfer-type ink jet recording apparatus, an intermediate image is formed on the intermediate transfer member. Liquid is then removed from the intermediate image on the intermediate transfer member, and such an intermediate image is transferred to a recording medium to form a transferred image. When the transfer-type ink jet recording apparatus is used, the liquid is removed from the intermediate image, so that the feathering does not occur even in high-speed image output. In addition, conditions for the removal of the liquid are changed, whereby the amount of water contained in the image can be controlled, and so such an apparatus is suitable for use in output on various recording media.

In addition, Japanese Patent Application Laid-Open No. 2013-142794 discloses a method of arranging a roll nip type image fixing device and an endless press type gloss generation device after an image forming apparatus using a toner. An image formed passes through the gloss generation device, whereby a high-gloss image comparable to a silver halide photograph can be outputted.

SUMMARY OF THE INVENTION

The present inventors have carried out an extensive investigation in view of the above-described background art. As a result, it has been found that the following constitution has excellent performance for the problem as a transfer-type ink jet recording apparatus, thus leading to completion of the present invention.

According to the present invention, there is thus provided a transfer-type ink jet recording apparatus including an intermediate image forming unit for applying an ink containing a resin to an intermediate transfer member to form an intermediate image and a transfer unit for transferring the intermediate image to a recording medium, wherein the apparatus further comprises a heating unit for heating the intermediate image to a temperature equal to or higher than a minimum film forming temperature of the resin and a cooling unit for cooling the intermediate image heated by the heating unit to a temperature lower than a glass transition temperature of the resin to supply the image to the transfer unit.

According to the present invention, there can be provided a compact transfer-type ink jet recording apparatus by which high gloss image quality comparable to that of a silver halide photograph can be achieved at the same time as transfer.

Further features of the present invention will become apparent from the following description of exemplary embodiments with reference to the attached drawings.

BRIEF DESCRIPTION OF THE DRAWINGS

FIG. 1 is a schematic view of a transfer-type ink jet recording apparatus according to an embodiment of the present invention.

FIGS. 2A1, 2A2, 2B1 and 2B2 are drawings for explaining a difference in mechanism achieved by temperature conditions upon transfer of an ink aggregated layer from an intermediate transfer member to a recording medium.

DESCRIPTION OF THE EMBODIMENTS

Figure 3:
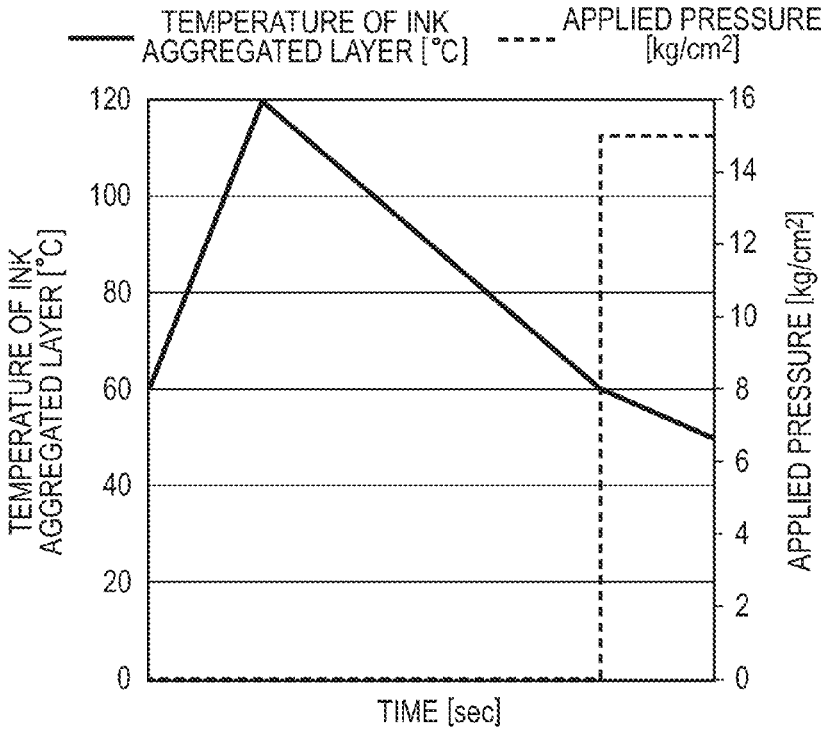
FIG. 3 is a chart illustrating the timing of heating and pressing with respect to an ink aggregated layer in Example 1.

Preferred embodiments of the present invention will now be described in detail in accordance with the accompanying drawings.

Even in the transfer-type ink jet recording apparatus, a printed article having high gloss image quality comparable to that of a silver halide photograph can be outputted by combination with such a gloss generation device as disclosed in Japanese Patent Application Laid-Open No. 2013-142794.

When the gloss generation device is combined with the transfer-type ink jet recording apparatus, however, the construction of the apparatus becomes complicated, and an installation space for the gloss generation device is newly required.

It is an object of the present invention is to provide an epoch-making transfer-type ink jet recording apparatus by which high gloss image quality comparable to that of a silver halide photograph can be achieved at the same time as a transferred image is formed on a recording medium.

The transfer-type ink jet recording apparatus according to the present invention is constructed by at least an intermediate transfer member, an image forming unit for forming an intermediate image, a heating unit for heating the intermediate image, a cooling unit for cooling the intermediate image and a transfer unit for transferring the intermediate image to a recording medium.

The image forming unit forms an intermediate image on the intermediate transfer member with an ink containing a resin for film formation by an ink jet method. The temperature of the intermediate image formed on the intermediate transfer member is controlled to a temperature necessary for transferring the intermediate image to a recording medium with high gloss image quality. This temperature control of the intermediate image is conducted by the heating unit for heating the intermediate image and the cooling unit for cooling the intermediate image to supply the image to the transfer unit.

The image forming unit has an ink jet recording head, and a liquid ink is applied to the intermediate transfer member from this ink jet recording head to form the intermediate image with the ink. When the intermediate image is subjected to a drying treatment, at least a portion of liquid components is removed from the liquid ink with which the intermediate image is formed, and an aggregable component contained in the liquid ink is aggregated to form an ink aggregated layer as a layer colored with a coloring material containing an aggregate.

A resin forming the ink into a film by heating, that is, a resin for film formation, is contained in the ink. This resin is added in the ink, whereby the ink aggregated layer forming the intermediate image can be formed into a film by heating the intermediate image on the intermediate transfer member to a temperature equal to or higher than the minimum film forming temperature (Tf) of this resin (preferably a temperature higher than the minimum film forming temperature (Tf) of this resin) to achieve a strong fixation state in the intermediate image.

In the present invention, the intermediate image is cooled to a temperature lower than the glass transition temperature (Tg) of the resin for film formation from a temperature equal to or higher than the minimum film forming temperature and then transferred to a recording medium from the intermediate transfer member. Such temperature control of the intermediate image is conducted, whereby a transferred image with high surface smoothness which realizes high gloss image quality comparable to that of a silver halide photograph can be obtained on the recording medium.

In the present invention, a mechanism by which the high gloss image quality can be imparted to the transferred image may be considered to be as follows.

When the ink aggregated layer forming the intermediate image is formed into a film by heating at the temperature equal to or higher than the above-described Tf, a bottom surface of the ink aggregated layer formed into the film, that is, an interface with an image forming surface of the intermediate transfer member, becomes a smoothed surface along this image forming surface. When the ink aggregated layer is cooled to a temperature lower than Tg of the resin for film formation in that state, the bottom surface of the ink aggregated layer is solidified and fixed as a smooth surface corresponding to the intermediate image forming surface of the intermediate transfer member. On the other hand, a front surface layer portion of the ink aggregated layer retains a moderate softened state necessary for transfer. When the intermediate image is brought into contact with a recording medium in this state to conduct transfer, the front surface layer portion of the ink aggregated layer which retains the softened state deforms along the surface of the recording medium to get stuck. On the other hand, the bottom surface of the ink aggregated layer which has been fixed as the smooth surface is separated from the intermediate transfer member in such a state that the form of the smooth surface is retained, and transferred to the recording medium to become a surface (exposed surface) of the transferred image. The high gloss image quality comparable to that of a silver halide photograph is imparted to the surface of the transferred image through this transfer step.

FIGS. 2A1 and 2A2 schematically illustrate the above-described mechanism according to the present invention. FIGS. 2A1, 2A2, 2B1 and 2B2 are schematic views illustrating the transfer step of the ink aggregated layer from the intermediate transfer member 1 to the recording medium 3 by means of sections in its thickness direction. When the ink aggregated layer 2 forming the intermediate image is formed into a film by heating at a temperature equal to or higher than Tf, the bottom surface of the ink aggregated layer 2 becomes a smoothed surface along the image forming surface of the intermediate transfer member 1 as illustrated in FIG. 2A1. When the ink aggregated layer 2 is cooled to a temperature lower than Tg of the resin for film formation in that state, the bottom surface of the ink aggregated layer 2 is solidified and fixed as a smooth surface corresponding to the intermediate image forming surface of the intermediate transfer member 1. On the other hand, a surface layer portion (exposed portion) of the ink aggregated layer 2 retains a moderate softened state necessary for transfer. When the intermediate image is brought into contact with the recording medium 3 in this state to conduct the transfer, the surface layer portion of the ink aggregated layer 2 which retains the softened state deforms along the surface of the recording medium to get stuck as illustrated in FIG. 2A2. On the other hand, the bottom surface of the ink aggregated layer 2 which has been fixed as the smooth surface is separated from the intermediate transfer member 1 in such a state that the form of the smooth surface is retained, and transferred to the recording medium 3 to become a smoothed surface (exposed surface) of the transferred image.

Accordingly, in the present invention, the intermediate image forming surface of the intermediate transfer member has a function as a mold for smoothing the surface of the ink aggregated layer after the transfer to the recording medium. The function as the mold of the intermediate transfer member is developed by the above-described cooling to the temperature lower than Tg from the temperature equal to or higher than Tf, and so the high gloss image quality can be imparted to the transferred image on the recording medium through the transfer. Accordingly, the apparatus construction having the intermediate transfer member can be utilized as a gloss imparting device, and so there is no need to newly combine the gloss imparting device, and it is easy to compactify the apparatus.

In addition, an ink aggregated layer whose surface becomes a convexly curved surface corresponding to the form of an ink droplet applied to the intermediate image forming surface of the intermediate transfer member, that is, an ink aggregated layer whose thickness is ununiform may be formed in some cases. Even in such a case, the intended high gloss image quality can be imparted to the transferred image without being affected by the above convexly curved surface because the smoothness of a back surface of the ink aggregated layer is fixed by the cooling upon the transfer in the present invention.

On the other hand, the intermediate image is heated to a temperature higher than Tg of the resin for film formation upon the transfer under high-temperature heating conditions, and the ink aggregated layer forming the intermediate image is separated from the intermediate transfer member and transferred to the recording medium in a softened state. The form of the ink aggregated layer in the stage of being separated from the intermediate transfer member is fixed by cooling on the recording medium. In such a case, the surface of the ink aggregated layer after the transfer may not become a smooth surface in some cases because it is deformed by irregularities of the surface of the recording medium or by the influence of a convex form or concave form of the ink aggregated layer before the transfer. In such a case, the intended high gloss image quality comparable to that of a silver halide photograph cannot be obtained.

FIGS. 2B1 and 2B2 schematically illustrate a mechanism in the case where the above-described high gloss image quality comparable to that of the silver halide photograph cannot be obtained.

An ink aggregated layer 2 formed on the image forming surface of the intermediate transfer member 1 illustrated in FIG. 2B1 is in a softened state as a whole because the layer is heated to a temperature higher than Tg of the resin for film formation. The form of the ink aggregated layer 2 at the stage of being separated from the intermediate transfer member is fixed by cooling on a recording medium 3. At that time, the surface of the ink aggregated layer 2 after the transfer does not become a smooth surface as illustrated in FIG. 2B2 because it is deformed by irregularities of the surface of the recording medium 3 or by the influence of a convex form or concave form of the ink aggregated layer before the transfer.

The transfer-type ink jet recording apparatus according to an embodiment of the present invention and the outline of the operation thereof will hereinafter be described. Incidentally, "recording medium" in the present specification widely includes not only paper used in general printing, but also fabrics, plastics, films, and other printing media and recording media. The outline of an image forming method using the transfer-type ink jet recording apparatus according to the present invention will be first described.

A reaction liquid for increasing the viscosity of an ink by coming in contact with the ink is first applied to an intermediate transfer member by means of a roller-type coating device as a reaction liquid applying unit. When the intermediate transfer member then reaches a position of an ink jet recording head, an ink containing a resin is ejected on the intermediate transfer member from the ink jet recording head, whereby the ink reacts with the reaction liquid applied on to the intermediate transfer member in advance. An aggregable component contained in the ink is thereby aggregated to form an aggregate-containing layer, that is, an ink aggregated layer. A transfer aid liquid for aiding transfer may be additionally applied on to the ink aggregated layer. The transfer aid liquid is applied, whereby the transferability of an intermediate image to a recording medium from the intermediate transfer member can be more improved.

A volatile component such as water contained in the ink aggregated layer is removed by a drying device. The ink aggregated layer is then heated by a heating unit. In particular, the ink aggregated layer is heated to a temperature not lower than the minimum film forming temperature of the resin applied as a component of the ink, whereby scratch resistance can be imparted to an image finally obtained on the recording medium, and the fixation of the image is completed. The heated ink aggregated layer is then cooled by means of a cooling unit. It is more favorable to cool the ink aggregated layer until the elastic modulus of the ink aggregated layer becomes higher than the elastic modulus of the recording medium. Lastly, the cooled ink aggregated layer is transferred to the recording medium by a transfer unit. The ink aggregated layer is cooled, whereby the surface of the ink aggregated layer on the recording medium after the transfer becomes a surface form equivalent to that of the intermediate image forming surface of the intermediate transfer member. In particular, the smoothness of the intermediate image forming surface of the intermediate transfer member is set to be not lower than the finally desirable smoothness of the image, whereby a high-gloss image can be formed on the recording medium.

Respective component parts of the transfer-type ink jet recording apparatus according to the embodiment of the present invention, respective steps in image formation and respective materials used in the image formation will now be described.

The intermediate transfer member becomes a base which holds a reaction liquid and on which an intermediate image is formed, and has an intermediate image forming surface for forming the intermediate image. As examples of the construction of the intermediate transfer member, there may be mentioned a single construction composed of the same material and a construction having at least a support and a surface layer member constituting an intermediate image forming surface provided on the support.

The support can be formed from a material having a function of handling the intermediate transfer member to transmit necessary force to the intermediate transfer member.

The surface layer member can be formed of a material which can form an intermediate image forming surface capable of forming an intermediate image and of transferring the intermediate image to a recording medium.

The support and the surface layer member can be formed by respectively using individual single materials or using a plurality of different materials. In addition, the support and the surface layer member may respectively have individual single-layer structures or multi-layer structures.

As examples of the shape of the intermediate transfer member, there may be mentioned a sheet-shape, a roller-shape, a drum-shape and a belt-shape. When the intermediate transfer member is used in the form of an endless belt in the case of the intermediate transfer member of the belt-shape, the same intermediate transfer member can be continuously and repeatedly used, and so such a construction is an extremely favorable construction from the viewpoint of productivity.

The size of the intermediate transfer member may be freely selected according to the size of an intended print image. The support of the intermediate transfer member is required to have structural strength to such an extent that it can be used as the intermediate transfer member from the viewpoints of the conveyance accuracy and durability thereof. Metal, ceramic or resin is favorable as a material of the support. Among these, aluminum, iron, stainless steel, acetal resin, epoxy resin, polyimide, polyethylene, polyethylene terephthalate, nylon, polyurethane, silica ceramic or alumina ceramic is particularly used from the viewpoints of stiffness capable of withstanding a pressure upon transfer and dimensional accuracy, and moreover of characteristics required for alleviating inertia upon operation to improve the responsiveness of control. In addition, these materials may also be used in combination.

The surface layer member of the intermediate transfer member desirably has elasticity necessary for transfer because the intermediate image is brought into contact under pressure with a recording medium such as paper to transfer the intermediate image to the recording medium. When paper is used as the recording medium, the surface layer member of the intermediate transfer member favorably has a hardness within the range of 10° to 100°, more favorably has a hardness within the range of 20° to 60° as measured by Durometer Type A (according to JIS K 6253).

Various materials such as a polymer, a ceramic and a metal may be suitably used as a material of the surface layer member. However, various rubber materials and elastomeric materials are favorably used as the material of the surface layer member from the viewpoints of processing properties and the above-described elastic properties. For example, polybutadiene rubber, nitrile rubber, chloroprene rubber, silicone rubber, fluorinated rubber, urethane rubber, styrene elastomer, olefin elastomer, vinyl chloride elastomer, ester elastomer or amide elastomer is favorable. In addition, polyether, polyester, polystyrene, polycarbonate, a siloxane compound or a perfluorocarbon compound may also be suitably used.

In particular, nitrile-butadiene rubber, silicone rubber, fluorinated rubber and urethane rubber may be extremely favorably used from the viewpoints of dimension stability, durability and heat resistance.

A surface layer member obtained by combining different materials may also be favorably used. For example, a laminated material obtained by forming a film of silicone rubber on an endless-belt-shaped urethane rubber, a sheet obtained by laminating a silicone rubber on a PET (polyethylene terephthalate) film and a laminated material obtained by forming a film of a polysiloxane compound on a urethane rubber sheet are suitably used. In addition, a sheet obtained by using a cotton fabric or a woven fabric such as polyester or rayon as a base fabric and impregnating such a base fabric with a rubber material such as nitrile-butadiene rubber or urethane rubber may also be suitably used.

The image forming surface of the intermediate transfer member may be subjected to a proper surface treatment before use. Examples of such a surface treatment include a flame treatment, a corona treatment, a plasma treatment, a polishing treatment, a roughening treatment, an active energy ray (for example, UV, IR or RF) irradiation treatment, an ozone treatment, a surfactant treatment and a silane coupling treatment. It is also favorable to conduct some of these treatments in combination.

The surface roughness (Ra) of the image forming surface of the intermediate transfer member is favorably 0.1 μm or less, that is, no more than 0.1 μm.

Various kinds of adhesive or a double coated tape may also be caused to be present between the surface layer member and the support for fixing and holding these members.

Reaction Liquid:

A reaction liquid capable of causing an aggregation reaction with an ink may also be applied to the intermediate image forming surface of the intermediate transfer member before the application of the ink for the purpose of increasing the viscosity of the ink applied on to the intermediate transfer member to improve the stabilization and transferability of the intermediate image.

The reaction liquid contains an ink-viscosity-increasing component. Here, the increase of the ink viscosity includes not only the case where a coloring material or a resin in the ink chemically reacts or physically adsorbs by the contact with the ink-viscosity-increasing component, whereby viscosity increase of the whole ink is observed, but also the case where local viscosity increase caused by aggregation of a portion of a component such as the coloring material is caused. The ink-viscosity-increasing component is applied to the intermediate image forming surface of the intermediate transfer member in advance, whereby the flowability of a liquid ink applied to the intermediate image forming surface is lowered. Thus, the ink-viscosity-increasing component has an effect to suppress bleeding and beading upon the formation of the intermediate image. One with which an aggregating effect can be achieved by intended ink viscosity increase may be chosen for use as the ink-viscosity-increasing component from, for example, polyvalent metal ions, organic acids, cationic polymers and porous fine particles. Among these, the polyvalent metal ions and organic acids are particularly favorable. It is also favorable to contain plural kinds of ink-viscosity-increasing components.

Incidentally, the content of the ink-viscosity-increasing component in the reaction liquid is favorably 5% by mass or more based on the total mass of the reaction liquid.

Examples of a metal ion usable as the ink-viscosity-increasing component include divalent metal ions such as $Ca^{2+}$, $Cu^{2+}$, $Ni^{2+}$, $Mg^{2+}$, $Sr^{2+}$, $Ba^{2+}$ and $Zn^{2+}$, and trivalent metal ions such as $Fe^{3+}$, $Cr^{3+}$, $Y^{3+}$ and $Al^{3+}$. Examples of an organic acid usable as the ink-viscosity-increasing component include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumalic acid, thiophenecarboxylic acid, nicotinic acid, oxysuccinic acid and dioxysuccinic acid.

The reaction liquid according to the present invention may contain proper amounts of water and an organic solvent. Water used in this case is favorably water deionized by, for example, ion exchange. No particular limitation is imposed on an organic solvent usable in the reaction liquid according to the present invention, and any of publicly known organic solvents may be used.

Various kinds of resins may also be added to the reaction liquid for the purpose of improving the transferability or improving the fastness properties of a finally formed image. The resin is added, whereby it is possible to obtain good adhesion of the intermediate image with respect to the recording medium upon the transfer and to improve the mechanical strength of the transferred image after being transferred to the recording medium.

Improvement in the water resistance of an image is also expected according to the kind of the resin. Any resin may be used as the resin to be added to the reaction liquid so long as it can coexist with the ink-viscosity-increasing component in the reaction liquid and has the above intended function. The resin used in such a purpose may be contained in the reaction liquid in a dissolved state, emulsion state or suspension state.

As the resin to be added to the reaction liquid, a resin which can achieve the intended effect may be chosen for use from those mentioned as examples of a resin component in the ink which will be described subsequently. Incidentally, a nonionic resin or a resin having the same polarity or electric charge as the ink-viscosity-increasing component in the reaction liquid in the case where the resin has a polarity or electric charge is favorably used as the resin.

A surfactant or a viscosity modifier may be added to the reaction liquid to suitably adjust the surface tension and viscosity of the reaction liquid before use. Any surfactant or viscosity modifier may be used so long as they can coexist with the ink-viscosity-increasing component and adjust the reaction liquid so as to have intended surface tension and viscosity. Examples of the surfactant include Acetylenol E100 (product of Kawaken Fine Chemicals Co., Ltd.).

Application of Reaction Liquid:

Publicly known various methods may be suitably used as a method for applying the reaction liquid to the intermediate image forming surface of the intermediate transfer member. Examples thereof include die coating, blade coating, a method using a gravure roller, a method using an offset roller and spray coating. In addition, a method of applying the reaction liquid according to an ink jet method using a liquid ejection head is also favorable. Further, it is also extremely favorable to use some methods thereof in combination.

Formation of Intermediate Image:

An ink is applied to that intermediate image forming surface of the intermediate transfer member to which the reaction liquid is applied by means of an ink jet recording head so as to form an image. In addition, it is more favorable to additionally apply a transfer aid liquid for aiding transfer on to the ink image.

Examples of an ink ejection system in the ink jet recording head include the following respective systems:

A method in which film boiling is caused in an ink by an electrothermal converter to form a bubble, thereby ejecting the ink;

A method in which an ink is ejected by an electromechanical converter; and

A method in which an ink is ejected by utilizing static electricity.

The construction of the ink jet recording head used in the formation of an intermediate image may be any construction so long as the intermediate image can be formed with an ink containing a resin for film formation. Among others, an ink jet recording head in which an ink ejection system utilizing an electrothermal convertor is adopted is favorably used from the viewpoint of forming a high-density image at a high speed in particular.

No particular limitation is imposed on an operation mode of the ink jet recording head. An ink jet head of what is called a shuttle mode in which the intermediate image is formed while scanning the head perpendicularly to the moving direction of the intermediate transfer member or an ink jet head of what is called a line head mode in which ink ejection orifices are arranged in a line substantially perpendicularly to a moving direction of the intermediate transfer member (namely, substantially in parallel to the axial direction in the case where the intermediate transfer member is a drum shape) may also be used.

In addition, no particular limitation is also imposed on the recording method, and any of the following recording methods may be used in the case of the ink jet recording head of the shuttle mode.

A multi-pass recording method in which recording is conducted by scanning the same recording position plural times; and A one-pass recording method in which recording is conducted by scanning the same recording position only one time.

Further, a method in which recording is conducted by dividing an image into plural mask patterns may also be used.

Ink:

Respective components used in the preparation of the ink will hereinafter be described.

Coloring Material:

An ink for forming the intermediate image may be prepared by using at least a coloring material, a resin for film formation and a liquid medium.

As the coloring material, at least one of dyes, carbon black and organic pigments which can be utilized as the coloring material of the ink may be used. The coloring material may be contained in the ink in a state of being dissolved and/or dispersed in a liquid medium. Among others, various pigments are favorable from the viewpoints of durability and quality of a resulting printed article.

Pigment:

No particular limitation is imposed on the pigment, and any publicly known inorganic pigment or organic pigment may be used. Specifically, pigments indicated by C.I. (COLOR INDEX) numbers may be used. In addition, carbon black is favorably used as a black pigment. As examples of the pigment, there may be mentioned self-dispersible pigments and dispersant-dispersible pigments dispersed by a dispersant. One of these pigments may be used, or two or more thereof may also be used in combination.

The content of the coloring material in the ink is favorably 0.5% by mass or more to 15.0% by mass or less, more favorably 1.0% by mass or more to 10.0% by mass or less based on the total mass of the ink.

Pigment Dispersant:

Any dispersant may be used as a dispersant for dispersing the dispersant-dispersible pigment so long as it has a function of dispersing the pigment in an ink jet ink. When the ink is an aqueous ink, any dispersant may be used so long as it is used for dispersing the pigment in the aqueous ink. For example, one of the dispersants for dispersing pigments used in publicly known ink jet aqueous inks may be used, or two or more thereof may also be used in combination.

Among others, a water-soluble dispersant having both hydrophilic portion and hydrophobic portion at the same time in its molecular structure is favorably used as the dispersant for the aqueous ink. In particular, a pigment dispersant composed of a resin containing at least a hydrophilic monomer and a hydrophobic monomer and obtained by copolymerizing such monomers is favorably used. No particular limitation is imposed on the respective monomers used here so long as an intended dispersant can be obtained. For example, publicly known monomers may be chosen for use. Specifically, examples of the hydrophobic monomer include styrene, styrene derivatives, alkyl (meth)acrylates and benzyl (meth)acrylate. Examples of the hydrophilic monomer include acrylic acid, methacrylic acid and maleic acid.

The acid value of the dispersant is favorably 50 mg KOH/g or more to 550 mg KOH/g or less. In addition, the weight-average molecular weight of the dispersant is favorably 1,000 or more to 50,000 or less.

Incidentally, the ratio of the pigment to the dispersant is favorably within the range of from 1:0.1 to 1:3. As the self-dispersible pigment, there may be mentioned a pigment obtained by subjecting the pigment itself to surface modification to be capable of being dispersed in an aqueous liquid medium of the ink.

Resin Component:

The ink contains a resin component for forming the ink aggregated layer into a film. This resin for film formation does not participate in coloring of the ink and is a component necessary for forming the ink aggregated layer into a film by heating and for transferring it. As a constituent material of this resin component, that having physical properties capable of conducting a transfer process according to the present invention may be chosen for use from those used for forming the ink aggregated layer into a film. In other words, a resin particle having a minimum film forming temperature and a glass transition temperature which are applicable to the transfer type-ink jet recording apparatus according to the present invention is used.

No particular limitation is imposed on the material of the resin particle, and a publicly known resin may be suitably used. Specific examples thereof include homopolymers such as polyolefin, polystyrene, polyurethane, polyester, polyether, polyuria, polyamide, polyvinyl alcohol, poly (meth)acrylic acid and salts thereof, polyalkyl (meth)acrylates, and polydiene, and copolymers obtained by combining a plurality of monomers among materials forming these homopolymers. The mass-average molecular weight of the resin forming the particle is favorably within the range of 1,000 or more to 2,000,000 or less. The content of the resin particle in the ink is favorably 1% by mass or more to 50% by mass or less, more favorably 2% by mass or more to 40% by mass or less based on the total mass of the ink.

Upon the preparation of the ink, the resin particle is favorably used in the form of a resin fine particle dispersion in which a resin fine particle is dispersed in a liquid. No particular limitation is imposed on the dispersion method. However, what is called a self-dispersible resin fine particle dispersion obtained by dispersing a particle composed of a resin obtained by homopolymerizing a monomer having a dissociating group or copolymerizing plural kinds of such monomers is favorable. Examples of the dissociating group used herein include a carboxyl group, a sulfonic acid group and phosphoric acid group. Examples of the monomer having this dissociating group include acrylic acid and methacrylic acid. In addition, what is called an emulsification-dispersion resin fine particle dispersion obtained by dispersing a resin fine particle with an emulsifier may also be favorably used likewise. As the emulsifier referred to herein, any emulsifier may be used irrespective of its molecular weight so long as an intended dispersing effect is achieved. For example, a publicly known surfactant is favorably used. The surfactant is favorably a nonionic surfactant or a surfactant having the same electric charge as the resin fine particle.

The resin particle is favorably a resin fine particle having a dispersion particle diameter of 10 nm or more to 1,000 nm or less. The dispersion particle diameter thereof is more favorably 100 nm or more to 500 nm or less.

It is also favorable to add various kinds of additives upon the preparation of the resin fine particle dispersion for stabilizing the dispersion. As examples of the additives, there may be mentioned n-hexadecane, dodecyl methacrylate, stearyl methacrylate, chlorobenzene, dodecylmercaptan, olive oil, a blue dye (Blue 70) and polymethyl methacrylate. One of these additives may be used, or two or more thereof may also be used in combination.

When the resin particle is added to an ink as a component which causes aggregation by a reaction with the ink-viscosity-increasing component in the reaction liquid in the case of using the reaction liquid, a resin particle which causes aggregation by a reaction with the ink-viscosity-increasing component in the reaction liquid is favorably used. For example, when the ink-viscosity-increasing component in the reaction liquid is cationic, an anionic resin particle is favorably used.

The minimum film forming temperature of the resin particle is favorably 180° C. or less, considering the thermal energy efficiency in forming the ink aggregated layer into a film by heating. In addition, the minimum film forming temperature of the resin particle is favorably equal to or higher than a temperature at which film formation takes place in an operational environment of the transfer-type ink jet recording apparatus, and it is favorably set to, for example, 100° C. or more.

The glass transition temperature (Tg) of the resin particle is favorably 100° C. or less, considering the transferability of the ink aggregated layer formed into the film. In addition, the glass transition temperature (Tg) may be set to, for example, favorably 70° C. or more, more favorably 80° C. or more, considering the cooling efficiency upon transfer and the stability of the resulting image.

Incidentally, various kinds of fine particles may be contained for use in the ink in addition to the pigment and the resin component for film formation. These fine particles do not participate in coloring of the ink and may be added to the ink for the purpose of improving the quality and fixability of a resulting image. Constituent materials of these fine particles may be variously selected. Among others, resin fine particles other than the resin component for film formation may be used to such a degree as not to affect the setting of the heating temperature and transfer temperature of the ink aggregated layer in the transfer-type ink jet recording apparatus for more improving the quality and fixability of the image. As resins forming the resin fine particles other than the resin component for film formation, the various resins mentioned above may also be used, and they may also be a component which causes aggregation by a reaction with the ink-viscosity-increasing component in the reaction liquid.

Surfactant:

The ink may contain a surfactant. Specific examples of the surfactant include Acetylenol EH (product of Kawaken Fine Chemicals Co., Ltd.). The content of the surfactant in the ink is favorably 0.01% by mass or more to 5.0% by mass or less based on the total mass of the ink.

Water and Water-Soluble Organic Solvent:

The ink contains a liquid medium. Water or a mixed solvent of water and a water-soluble organic solvent can be used as the liquid medium. Water is favorably water deionized by, for example, ion exchange. The content of water in the ink is favorably 30% by mass or more to 97% by mass or less based on the total mass of the ink.

No particular limitation is imposed on the kind of the water-soluble organic solvent, and any of publicly known organic solvents used in ink jet aqueous inks may be used. Specific examples thereof include glycerol, diethylene glycol, polyethylene glycol and 2-pyrrolidone. In addition, the content of the water-soluble organic solvent in the ink is favorably 3% by mass or more to 70% by mass or less based on the total mass of the ink.

Other Additives:

The ink may also contain various additives such as a pH adjustor, a rust preventive, a preservative, a mildewproofing agent, an antioxidant, an antireducant, a water-soluble resin and a neutralizer thereof, and a viscosity modifier, as needed, in addition to the above-described components. One of these additives may be used, or two or more thereof may also be used in combination.

Removal of Liquid Component:

It is also favorable to provide a step of reducing the content of a liquid component (mainly water and a volatile liquid component in the case of an aqueous ink,) from the intermediate image formed by applying the ink from the ink jet recording head as well as a unit therefor. If the liquid component in the intermediate image is excessive, the cause of image disorder may be generated.

As a method for removing the liquid component, various methods which have been utilized in a fixing treatment by drying an image formed with an ink may be used. For example, a method by heating, a method of using a low-humidity air blow, a method of reducing a pressure or a method of combining these methods may be utilized. In addition, it is also possible to remove the liquid component by natural drying. The content of the liquid component is reduced from ink droplets forming the intermediate image on the intermediate image forming surface of the intermediate transfer member, whereby an aggregable component such as the resin for film formation in the ink is aggregated to form an ink aggregated layer containing an aggregate from the ink droplets.

Heating Unit for Colored Film Formation:

The intermediate image is heated by heating on the intermediate transfer member, thereby forming the ink aggregated layer forming the intermediate image into a film. By this film formation, the ink aggregated layer becomes an ink aggregated layer in which the coloring material is taken in to form into a film, that is, a colored film. No particular limitation is imposed on the heating unit used in this film formation of the ink aggregated layer so long as an intended heating treatment can be conducted. For example, a heating unit of a method in which the intermediate image is directly heated or a heating unit of a method in which the intermediate image is heated indirectly through the intermediate transfer member may be utilized. In addition, when the heating units of these methods are used in combination, the heating can be more favorably conducted. As examples of the heating unit, there may be mentioned a hot air blower such as a fan heater, a hot air dryer, an infrared heating device, a flash fixing device and a heating device such as a halogen heater. In addition, a heating unit of a method in which a support portion of the intermediate transfer member is formed of a material such as a metal capable of conducting electromagnetic induction heating to conduct heating by electromagnetic induction may also be used.

The heating unit for film formation of the ink aggregated layer forming the intermediate image may also be utilized in the above-described liquid-component-removing (drying) treatment with respect to the intermediate image. The common heating unit is used in this manner, whereby a treatment from the drying of the intermediate image by the heating unit to the film formation of the ink aggregated layer can be conducted by the common heating unit.

The heating unit favorably has a construction capable of changing the heating temperature according to the minimum film forming temperature and glass transition temperature of the resin for film formation as an ink component.

Cooling Unit for Cooling of Intermediate Image:

No particular limitation is imposed on the cooling unit for cooling the intermediate image on the intermediate transfer member to accelerate the fixation of the smoothness of a bottom surface of the colored film forming the intermediate image so long as an intended cooling treatment can be conducted. For example, a cooling unit of a method in which the intermediate image is directly cooled or a cooling unit of a method in which the intermediate image is cooled indirectly from a back surface opposing the intermediate image forming surface of the intermediate transfer member may be used. The cooling units of these systems may also be used in combination. As the cooling unit directly cooling the intermediate image, a cold air blower which provides by a fan a blow of air cooled by a cooling device may be utilized. As examples of the cooling unit for cooling the intermediate image from the back surface of the intermediate transfer member, there may be mentioned a heat dissipation device that conducts cooling by bringing a metallic fin into contact with the back surface of the intermediate transfer member to dissipate heat into the air, a heat dissipation device that applies an air blow to a metallic fin in contact with the back surface of the intermediate transfer member to increase the heat dissipation efficiency, a cooling device utilizing a Peltier effect and a cooling device utilizing vapor compression.

The cooling unit also favorably has a construction capable of changing the cooling temperature according to the minimum film forming temperature and glass transition temperature of the resin for film formation as the ink component.

It is necessary to shorten the moving time of the intermediate image from the heating unit to a transfer unit for speeding up the image formation and compactifying the apparatus, and so the cooling unit is essential in the present invention, because a sufficient cooling time for the intermediate image cannot be secured by the natural cooling.

Transfer Unit:

No particular limitation is imposed on the method for bringing a recording medium into contact with the intermediate transfer member as well as a unit therefor when the intermediate image formed on the intermediate transfer member is transferred to the recording medium so long as the intended transfer step can be conducted. As a transfer unit, there may be mentioned a transfer device having a transfer roller. As the transfer device having the transfer roller, there may be mentioned transfer devices of the following methods:

(A) A method in which a recording medium is brought into contact with the intermediate image on the intermediate transfer member tensioned by a transfer roller to conduct transfer.

(B) A method in which a recording medium is brought into contact with the intermediate image on the intermediate transfer member, and such a stacked portion is inserted into a nip portion formed of a transfer roller and a support guide or support roller facing the transfer roller to conduct transfer.

In the method (A), the support guide or support roller is not provided on a surface opposing a surface of the intermediate transfer member with which the transfer roller is brought into contact, and such a surface is opened. Therefore, a contact pressure of the transfer roller with the intermediate transfer member can be obtained by a tension applied to the intermediate transfer member by tensioning and a push pressure for the transfer roller to press it against the intermediate transfer member.

In the system (B), a pressure necessary for the transfer can be obtained by a pressure from the transfer roller which is applied to the nip portion formed of the support guide or support roller and the transfer roller. The transfer device may have a multistage roller in which a plurality of transfer rollers are arranged in series in a conveying direction of the intermediate image on the intermediate transfer member. The stacked portion of the intermediate image and the recording medium is pressed in multi-stages by means of the multistage roller, whereby transfer failure can be effectively prevented.

A heating unit can be provided in the transfer unit. In the case of the transfer device having the transfer roller, a transfer device having such a construction that the heating unit such as a heater is arranged on the inside of the transfer roller to control the temperature upon the transfer of the intermediate image is favorable. Incidentally, the heating heater may also be arranged partially in the interior of the transfer roller. However, it is more favorable to arrange the heater all over the whole circumferential surface (contact surface with the recording medium) of the transfer roller. The heating device provided in the transfer unit favorably has a construction capable of changing the heating temperature in such a manner that a transfer temperature necessary for obtaining an intended transferred image on the recording medium can be applied to the transfer roller.

Hydrophilization Treatment for Recording Medium:

It is also favorable to subject an intermediate image transferring surface of the recording medium to a hydrophilization treatment in advance for improving the transferability. The surface of the recording medium is hydrophilized to lower the dynamic contact angle of an ink with respect to the recording medium, whereby the interaction between the ink aggregated layer and the recording medium is increased, and so the ink aggregated layer is efficiently transferred to the recording medium.

The step of subjecting the recording medium to the hydrophilization treatment in advance is favorably a physical surface treatment step. Here, the physical surface treatment step means that which is an electrical or mechanical treatment without depending on a chemical treatment such as application of water and a chemical substance. The physical surface treatment step is conducted by a unit capable of lowering the dynamic contact angle of the ink on the surface of the recording medium in that step. Examples of the electrical treatment include an atmospheric pressure plasma treatment, a corona discharge treatment, an excimer lamp treatment and a UV ozone treatment. In addition, examples of the mechanical treatment include a roughening treatment with respect to the surface of the recording medium.

Transfer Aid Liquid:

The transfer aid liquid contains a component for additionally applying adhesion to the recording medium upon transfer to the surface of the intermediate image to improve the transferability thereof and is applied on to the ink aggregated layer forming the intermediate image formed on the intermediate transfer member.

The transfer aid liquid favorably has a composition and physical properties suitable to an application method to the recording medium. When the transfer aid liquid is applied on to the intermediate image by an ink jet method, the transfer aid liquid is favorably prepared in the form of an aqueous liquid.

As the component contained in the transfer aid liquid to improve the transferability of the intermediate image to the recording medium, a resin component capable of achieving a softened state necessary for the improvement of the transferability at a transfer temperature may be used. As this resin component, a component having an intended Tg may be chosen for use from the water-soluble resins serving as the pigment dispersants and the resin particles for film formation of the ink aggregated layer as mentioned above as the components of the ink.

In addition, in the ink in the transfer aid liquid to be applied to the intermediate image by the ink jet method, the respective components of the ink such as the fine particle, surfactant, aqueous liquid medium and other additives except the coloring material as mentioned above as the components of the ink may be used in the respective content proportions.

The transfer-type ink jet recording apparatus according to an embodiment of the present invention will now be described.

FIG. 1 is a schematic view illustrating the outline construction of the transfer-type ink jet recording apparatus according to the embodiment of the present invention.

An intermediate image forming surface of an intermediate transfer member 101 in this embodiment has smoothness for applying high gloss to a transferred image formed on a recording medium 107. The smoothness of the intermediate image forming surface of the intermediate transfer member 101 is set to be not lower than the smoothness of the surface of the transferred image which is desired to finally get on the recording medium 107, whereby a high-gloss image can be more effectively formed on the recording medium. In FIG. 1, the intermediate transfer member 101 is held in the form of an endless belt laid between support rollers as a pair of rotatable cylindrical support members. One of the support rollers is arranged as a heating roller 114 with a built-in heating unit 112.

These support rollers are driven rotatably on an axis in the direction of the arrow, and respective devices arranged around them are actuated in synchronism with the rotation thereof. In other words, a conveying unit of the intermediate transfer member is constructed by these support rollers, and the respective devices of a roller-type reaction liquid applying device 102, an ink jet recording head 103, a liquid ejection head 104, a heating device 105, a heating roller 114, a cooling device 106 and a transfer roller 108 are arranged in this order along a conveying direction of the intermediate transfer member 101.

An image forming unit in this apparatus is constructed by the ink jet recording head 103 and the reaction liquid applying device 102. Incidentally, the reaction liquid applying device may be provided as needed.

A unit for controlling the temperature of the intermediate image in this apparatus has the heating unit 112 incorporated in the heating roller 114, the cooling unit 106 and a heating unit incorporated in the transfer roller 108.

An image forming operation in the apparatus illustrated in FIG. 1 will hereinafter be described.

A reaction liquid 113 is applied to the intermediate transfer member 101 by means of a coating roller of the coating device 102. When the intermediate image forming surface of the intermediate transfer member 101 then reaches the position of the ink jet recording head 103, at least one of black, cyan, magenta and yellow inks is ejected from the ink jet recording head 103, and so the reaction liquid applied on to the intermediate transfer member 101 in advance reacts with the ink to form an ink aggregated layer 32 forming an intermediate image on the intermediate transfer member 101.

Incidentally, the ink aggregated layer is formed on to the intermediate transfer member in the form of a layer composed of a single dot obtained by an ink droplet applied to the intermediate image forming surface of the intermediate transfer member, a layer composed of plural dots linking to each other or a single layer all over the whole surface of a predetermined area. The intermediate image can be formed by at least one thereof.

When the intermediate image on the intermediate transfer member 101 then reaches the intermediate transfer member heating device 105, the water content is removed from the ink aggregated layer 32 forming the intermediate image, and moreover the ink aggregated layer 32 is heated, In addition, when the intermediate image reaches the position of the heating roller 114 with the built-in heating unit 112, the ink aggregated layer 32 is further heated to a temperature equal to or higher than the minimum film forming temperature of the ink, whereby the ink aggregated layer 32 is formed into a film, and becomes a colored film, and so the image is fixed. When the intermediate image composed of the ink aggregated layer formed into the film reaches the cooling device 106, the intermediate transfer member 101 and the ink aggregated layer 32 are cooled.

When the intermediate image further reaches the position of the transfer roller 108, the ink aggregated layer 32 forming the intermediate image comes into contact with a recording medium 107 retained at a temperature around room temperature, and the ink aggregated layer is further cooled and transferred to the recording medium 107. At this time, the ink aggregated layer 32 is cooled to a temperature lower than the glass transition temperature of the resin applied as an ink component and necessary for the transfer.

Incidentally, the temperature of the intermediate image upon the transfer can be controlled by the heating unit incorporated in the transfer roller 108.

An exemplary timing chart of heating and pressing with respect to the ink aggregated layer forming the intermediate image will now be explained with reference to FIG. 3. In FIG. 3, the ink aggregated layer 32 forming the intermediate image is heated to 120° C. by the heating unit 112 and formed into a film to become a colored film, and so the intermediate image is fixed. The ink aggregated layer forming the intermediate image is then cooled to 60° C. by the cooling device 106. Until this step, the temperature of the ink aggregated layer is higher than the glass transition temperature (Tg) of the resin for film formation applied as the ink component, so that the form of the surface of the intermediate image is deformed to become a low-gloss image when the ink aggregated layer is intended to be transferred by applying a pressure.

On the contrary, the ink aggregated layer is transferred to the recording medium 107 from the time when the temperature of the ink aggregated layer reaches 60° C. which is a temperature lower than the Tg of the resin for film formation, whereby the form of the surface of the intermediate image is not deformed even when the ink aggregated layer is transferred to the recording medium 107 by applying a pressure thereto, and so a high-gloss image can be obtained.

On the other hand, a case where a gloss applying treatment to an image surface by the conventional endless press-type gloss generation device is conducted to the ink aggregated layer formed on the recording medium using the reaction liquid and the resin-containing ink will hereinafter be described with reference to FIGS. 4A and 4B.

Figure 4A:
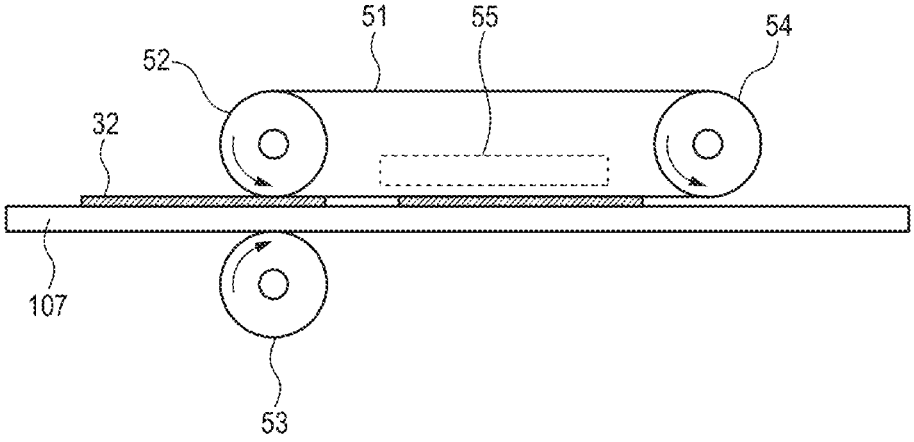
FIG. 4A is a schematic view of an endless press-type gloss generation device.

FIG. 4A schematically illustrates an endless press-type gloss generation device having a structure in which an endless fixing belt 51 is laid between two rollers 52 and 54. As illustrated in FIG. 4A, the ink aggregated layer 32 formed on the recording medium is heated and pressed by a heating roller 52 and a pressure roller 53, whereby the ink aggregated layer 32 is formed into a film and further deformed along the surface form of the fixing belt 51. The fixing belt 51 is sufficiently smoothed, whereby a high-gloss image can be obtained. However, when the image is intended to be separated from the fixing belt 51 in such a state that the temperature of the colored film obtained by forming the ink aggregated layer 32 into the film is higher than Tg of the resin for film formation, the colored film is transferred to the fixing belt 51 to cause image failure. Therefore, the image is cooled to a temperature lower than the Tg by means of a cooling device 55 and then separated from the fixing belt 51.

Figure 4B:
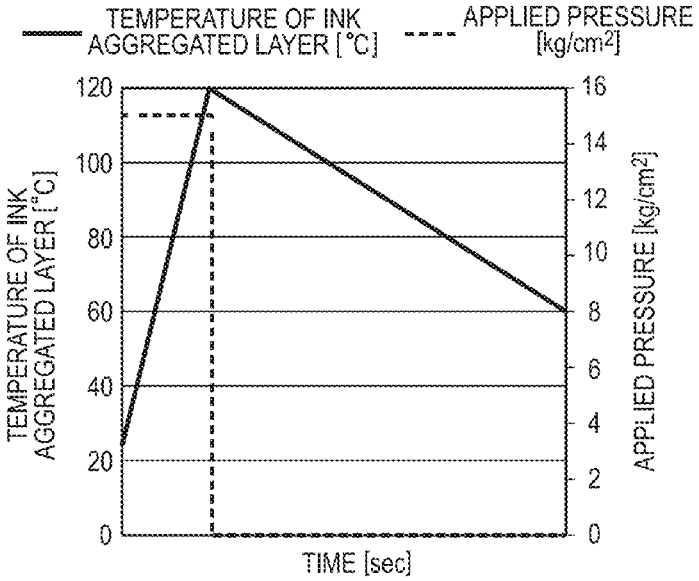
FIG. 4B is a chart illustrating the timing of heating and pressurization to an ink aggregated layer in the endless press-type gloss generation device.

FIG. 4B is a timing chart of a pressure applied to the intermediate image and a heating temperature of the intermediate image in the endless press-type gloss generation device. As described in FIG. 4A, the pressing under a pressure of 15 kg/cm$^2$ and the heating by the heating roller 52 are conducted at the same time to the ink aggregated layer 32, so that the temperature of the ink aggregated layer 32 is raised to 120° C. to form the ink aggregated layer into a film. Thereafter, the colored layer obtained from the ink aggregated layer 32 is cooled to 60° C., which is a temperature lower than the glass transition temperature of the resin for film formation contained in the ink, by the cooling device 55 while being held by the fixing belt 51 in a no-pressure state. In the endless press-type gloss generation device, a high-gloss image can be obtained by carrying out the heating and pressing to the ink aggregated layer 32 at the same time, conducting the cooling in the no-pressure state and then separating the image.

In this embodiment, a high-gloss image can be obtained by cooling the intermediate image and then transferring it to the recording medium 107 at the same time as pressure application because a low-gloss image is obtained when the transfer is conducted by pressure application with the intermediate image being heated.

The temperature of the ink aggregated layer is raised to a temperature equal to or higher than Tf (film forming temperature) of the resin for film formation, whereby the transferred image transferred to the recording medium 107 is fixed to improve the scratch resistance thereof. In addition, the transfer is conducted after the temperature of the intermediate image is made lower than Tg of the resin for film formation, whereby a smoothness corresponding to the surface of the intermediate transfer member 101 is imparted to the surface of the transferred image transferred to the recording medium 107, and so high gloss is imparted.

The apparatus illustrated in FIG. 1 has such a construction that no device for treating the intermediate image is provided between the heating roller 114 and the cooling device 106, and the intermediate image formed on the intermediate image forming surface of the intermediate transfer member 101 is conveyed while the stacked state of the intermediate image forming surface and the intermediate image. By virtue of this construction, a treatment such as pressure application is not conducted while the ink aggregated layer forming the intermediate image keeps a temperature higher than the above-described Tg, so that the smoothness of a bottom surface which is an interface between the ink aggregated layer and the intermediate image forming surface can be retained.

As illustrated in FIG. 1, a liquid ejection head 104 as a transfer aid liquid applying unit for applying a transfer aid liquid for improving the transferability of the intermediate image to the recording medium may be provided, as needed, on a downstream side of the ink jet recording head 103 in the conveying direction of the intermediate image. Liquid applying devices of various methods may also be used as this transfer aid liquid applying unit. A liquid ejection head for ejecting a liquid by an ink jet method as illustrated in FIG. 1 is favorably used as this liquid ejection head.

Figure 5A:
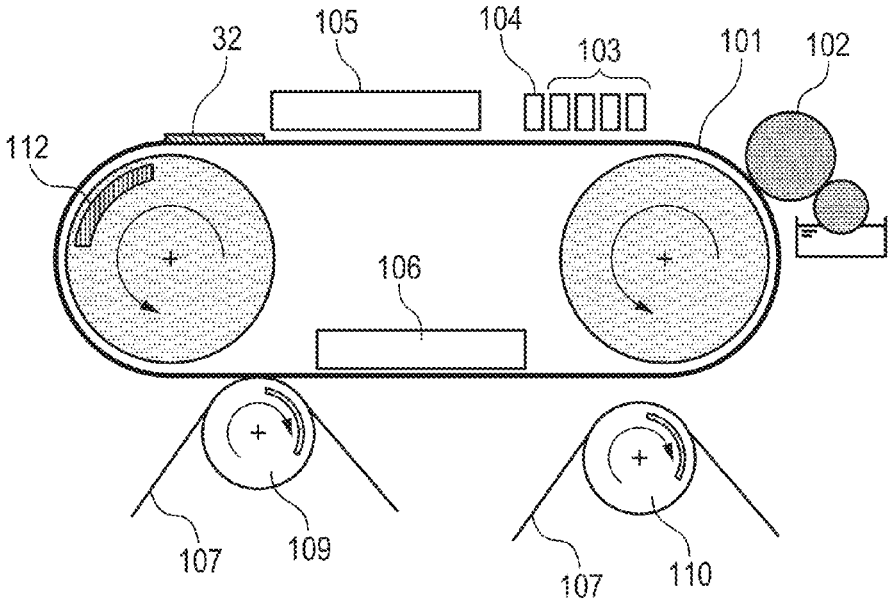
FIGS. 5A and 5B are schematic views of a transfer-type ink jet recording apparatus according to another embodiment of the present invention.
Figure 5B:
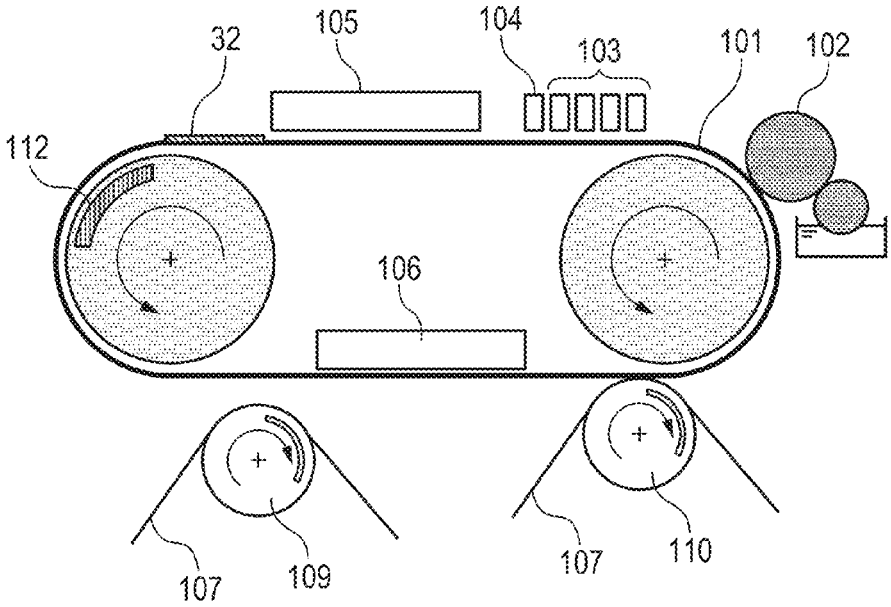
Figure 6:
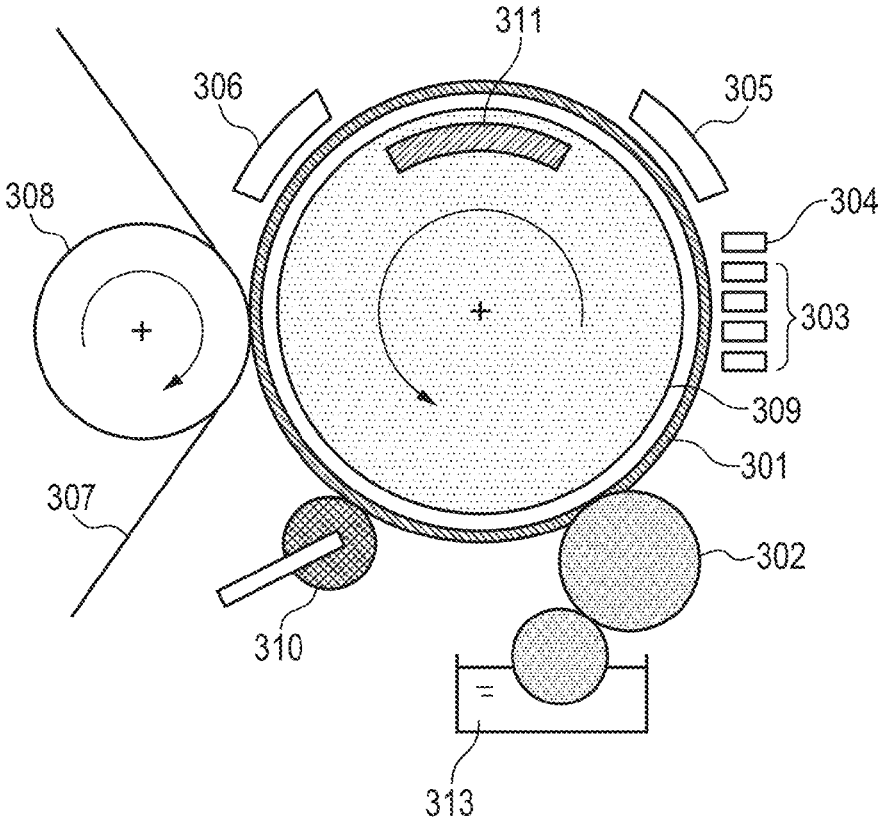
FIG. 6 is a schematic view of a transfer-type ink jet recording apparatus according to a further embodiment of the present invention.

The transfer-type ink jet recording apparatus according to other embodiments of the present invention are illustrated in FIGS. 5A and 5B, and FIG. 6. The apparatus illustrated in FIGS. 5A and 5B has, as a first transfer unit, a transfer unit for transferring an intermediate image cooled by a cooling unit and has, as a second transfer unit, another transfer unit for transferring an intermediate image heated by the above-described heating unit to a recording medium at a temperature not lower than the glass transition temperature of the resin applied as the ink component. Transfer modes of the intermediate image by these transfer units (the first transfer unit and the second transfer unit) can be switched according to the kind of image quality relating to the gloss of an image outputted to a recording medium. In other words, the apparatus illustrated in FIGS. 5A and 5B has a switching unit for selectably conducting switching to one of the intermediate image transfer modes of these transfer units.

The apparatus illustrated in FIGS. 5A and 5B has a first transfer roller 110 as the first transfer unit for imparting gloss to a transferred image and a second transfer roller 109 as the second transfer unit for obtaining a transferred image for which it is unnecessary to impart gloss. The apparatus has the same construction as the apparatus illustrated in FIG. 1 except that the second transfer roller 109 is added.

The second transfer roller 109 of the apparatus illustrated in FIGS. 5A and 5B is arranged between the heating roller 114 with the built-in heating unit 112 and the cooling unit 106. Switching between formation of a low-gloss image and formation of a high-gloss image can be simply realized by the arrangement of these transfer rollers.

For the apparatus illustrated in FIG. 1, the unit for forming an high-gloss image with a very low surface roughness Ra has been described. In the embodiment illustrated in FIGS. 5A and 5B, however, switching between formation of a high-gloss image with a very low surface roughness Ra and formation of a low-gloss image with a high surface roughness Ra can be simply realized. Specifically, when the intermediate image reaches the heating device 105 as illustrated in FIG. 5A, the water content is removed, and at the same time, the ink aggregated layer is heated. In addition, when the intermediate image reaches the position of the heating roller 114 with the built-in heating unit 112, the ink aggregated layer is further heated to a temperature equal to or higher than the minimum film forming temperature (Tf) of the resin for film formation applied as the ink component to form the ink aggregated layer into a film. When the intermediate image then reaches the position of the second transfer roller 109, the intermediate image is transferred to a recording medium 107 from the intermediate transfer member 101 with the temperature of the colored film forming the intermediate image being high, whereby a low-gloss image can be obtained.

On the other hand, the transfer roller 109 is separated from the intermediate transfer member 101 as illustrated in FIG. 5B, and the intermediate image formed on the intermediate transfer member 101 is transferred to a recording medium 107 in the same manner as in the apparatus illustrated in FIG. 1 when the intermediate image reaches a position of the first transfer roller 110, whereby a high-gloss transferred image can be obtained.

As described above, both first transfer roller 110 and second transfer roller 109 are provided movably between a contact position for transfer to the intermediate transfer member 101 and a position of separation from the intermediate transfer member 101, and so these transfer rollers can be properly used according to the intended glossiness of the transferred image.

FIG. 6 illustrates an embodiment of a transfer-type ink jet recording apparatus in which a cylindrical intermediate transfer member is rotatably provided. The apparatus illustrated in FIG. 6 has an intermediate transfer member 301 on an outer peripheral surface of a cylindrical substrate 309, and an intermediate image forming surface of the intermediate transfer member 301 is moved in accordance with rotation of the substrate 309 in the direction of the arrow. Respective devices of a coating device 302, an ink jet recording head 303, a liquid ejection head 304 for application of the transfer aid liquid, a heating device 305, a heating unit 311, a cooling device 306 and a transfer roller 308 are arranged in this order along a moving path of the intermediate transfer member 301.

An image forming unit in this apparatus is constructed by the ink jet recording head 303 and the coating device 302. Incidentally, the coating device 302 for applying a reaction liquid 313 to the intermediate transfer member 301 may be provided as needed. In addition, the liquid ejection head 304 for applying the transfer aid liquid may also be provided as needed. Further, a cleaning unit 310 may be provided as needed.

A unit for controlling the temperature of the intermediate image in this apparatus is constructed by the heating unit 311 and the cooling device 306.

The operation of the respective devices in the formation of a transferred image by this apparatus is the same as in the respective devices illustrated in FIG. 1 except that the intermediate transfer member 301 is arranged on the outer peripheral surface of the substrate 309, and the intermediate image forming surface is moved in accordance with the rotation of the substrate 309.

EXAMPLES

The present invention will hereinafter be described more specifically by Examples of the transfer-type ink jet recording apparatus according to the present invention. The present invention is not limited by the following Examples unless going beyond the gist thereof. Incidentally, all designations of "part" or "parts" and "%" in the following are based on mass unless expressly noted.

Preparation Example 1

Preparation of Reaction Liquid:

After the components of the following composition were mixed and the resultant mixture was sufficiently stirred, the mixture was filtered under pressure through a microfilter (product of Fuji Photo Film Co., Ltd.) having a pore size of 3.0 μm to collect a filtrate as a reaction liquid.

Levulinic acid: 40 parts

Glycerol: 5 parts

Surfactant: 1 part (Acetylenol E100, product of Kawaken Fine Chemicals Co., Ltd.)

Resin fine particle (polyacrylic acid): 3 parts

Ion-exchanged water: 51 parts.

Preparation of Ink:

Preparation of Black Pigment Dispersion Liquid:

Ten percent of carbon black (trade name: Monarch 1100, product of Cabot Co.), 15% of an aqueous pigment dispersant solution (styrene-ethyl acrylate-acrylic acid terpolymer (acid value: <150 mg KOH/g, weight-average molecular weight: 8,000>); solid content: 20%; neutralized with potassium hydroxide) and 75% of pure water were mixed. A batch type vertical sand mill (manufactured by IMEX Co.) was charged with the resultant mixture and 200% of zirconia beads having a diameter of 0.3 mm to conduct a dispersing treatment for 5 hours while cooling with water. The thus-obtained dispersion liquid was centrifuged by a centrifugal separator to remove coarse particles, thereby obtaining a black pigment dispersion liquid having a pigment concentration of about 10%.

Preparation of Cyan Pigment Dispersion Liquid:

A cyan pigment dispersion liquid was prepared in the same manner as in the preparation of the black pigment dispersion liquid except that 10% of carbon black used upon the preparation of the black pigment dispersion liquid was changed to 10% of C.I. Pigment Blue 15:3.

Preparation of Magenta Pigment Dispersion Liquid:

A magenta pigment dispersion liquid was prepared in the same manner as in the preparation of the black pigment dispersion liquid except that 10% of carbon black used upon the preparation of the black pigment dispersion liquid was changed to 10% of C.I. Red 122.

Preparation of Yellow Pigment Dispersion Liquid:

A yellow pigment dispersion liquid was prepared in the same manner as in the preparation of the black pigment dispersion liquid except that 10% of carbon black used upon the preparation of the black pigment dispersion liquid was changed to 10% of C.I. Pigment Yellow 74.

Preparation of Resin Fine Particle Dispersion:

Eighteen percent of butyl methacrylate, 2% of 2,2'-azo-bis-(2-methylbutyronitrile) and 2% of n-hexadecane were mixed and stirred for 0.5 hours. This mixture was added dropwise to a 6% aqueous solution (mixing proportion: 78%) of NIKKOL BC15 (product of Nikko Chemicals Co., Ltd.) which is an emulsifier, and the resultant mixture was stirred for 0.5 hours. The mixture was then irradiated with ultrasonic waves for 3 hours by an ultrasonic wave irradiation machine. A polymerization reaction was then conducted for 4 hours at 80° C. under a nitrogen atmosphere, and filtration was conducted after cooling at room temperature to obtain a resin fine particle dispersion having a resin concentration of about 20%. The mass-average molecular weight of the resin fine particle was about 1,000 to about 2,000,000, and the dispersion particle size thereof was about 100 nm to about 500 nm. The minimum film forming temperature of the thus-obtained resin fine particle was 100° C. to 120° C., and the glass transition temperature (Tg) thereof was 70° C. to 80° C.

Preparation of Ink:

Black, cyan, magenta and yellow inks each having the following composition were respectively prepared. Specifically, the inks were prepared by mixing respective components of the following formulations, sufficiently stirring the resultant mixtures and then filtering the mixtures under pressure through a microfilter (product of Fuji Photo Film Co., Ltd.) having a pore size of 3.0 μm.

Formulation of Ink:

One of the above-described respective color pigment dispersion liquids (concentration: about 10%): 20%

Resin fine particle dispersion described above (concentration: about 20%): 50%

Glycerol: 12%

Acetylenol EH (product of Kawaken Fine Chemicals Co., Ltd.): 0.5%

Pure water: 17.5%.

Example 1

A transfer-type ink jet recording apparatus according to this example in which the respective parts illustrated in FIG. 1 were constructed in the following manner was provided.

As the ink jet recording head 103 for ejecting an ink, a head of such a type that ink ejection is conducted by an On-demand method using an electrothermal converter was used. As an ink jet recording head for each color ink, such a recording head of a line head form that ejection orifices are arranged in a line along substantially the whole width in a direction substantially perpendicular to a conveying direction of the intermediate image forming surface of the intermediate transfer member was used. The ink ejection amount from each ejection orifice of the ink jet recording head was 3 μl, the reaction liquid was applied in a coating amount of 1 g/m$^2$ to the intermediate image forming surface of the intermediate transfer member heated to 50° C., and recoding dot resolution was set to 1,200 dpi to form an intermediate image by the ink jet recording head.

As the intermediate transfer member 101, an endless belt of such a construction was used that a silicone rubber KE12 (product of Shin-Etsu Chemical Co., Ltd.) having a rubber hardness of 40° and a thickness of 0.1 mm was laminated as a surface layer member on the surface of a transparent PET film having a thickness of 0.5 mm as a support through a pressure sensitive adhesive double coated tape. The outer peripheral surface of this endless belt was subjected to a hydrophilization treatment under the following conditions by means of a parallel plate type normal pressure plasma treatment device APT-203 (manufactured by SEKISUI CHEMICAL CO., LTD.) to obtain an intermediate image forming surface.

Surface Hydrophilization Conditions:

Gas used: flow rate

Air: 1,000 cc/min

Nitrogen gas ($N_2$): 6000 cc/min

Input voltage: 230 V

Treatment speed: 20 sec/cm$^2$

The surface roughness Ra of the intermediate transfer member used was 0.02 and so such a member was very smooth. The surface roughness Ra is a value measured by Vert-Scan 4.0 available from Ryoka Systems Inc., and the following Ra values are also the same.

As the transfer roller 108, a heating and pressing roller with a built-in heater was used. The transfer of the intermediate image was carried out under conditions in which the pressure applied to the intermediate image on the intermediate transfer member 101 upon the transfer is 15 kg/cm$^2$, the time required to apply the pressure to the intermediate image is 900 msec, and the temperature of the transfer roller 108 is 60° C.

A heater was used as the heating device 105.

The reaction liquid and pigment inks obtained in Preparation Example 1 were respectively filled into a storage tank and ink tanks (not illustrated) of the ink jet recording heads in the transfer-type ink jet recording apparatus according to this embodiment.

Cast-coated paper is more favorable than gloss coated paper because its paper white smoothness is high and the glossiness also becomes higher. As examples of the cast-coated paper, there may be mentioned GLORIA PURE WHITE (product of Gojo Paper Mfg. Co., Ltd.; 210 gsm paper) and MIRROR COAT paper (product of Oji Paper Co., Ltd.; basis weight: 127.9 g/m$^2$). In this example, 210 gsm paper of GLORIA PURE WHITE (product of Gojo Paper Mfg. Co., Ltd.) was used.

The recording medium was set as a destination for transfer of the intermediate image to form an image through the following steps.

The reaction liquid 113 was applied to the intermediate image forming surface of the intermediate transfer member 101 by a coating roller of the coating device 102. At least one pigment ink selected from the black, cyan, magenta and yellow pigment inks was then ejected from the ink jet recording head 103 on the intermediate image forming surface which has reached an arrangement position of the ink jet recording head 103, thereby forming an intermediate image. The pigment ink forming the intermediate image reacted with the reaction liquid 113 applied in advance to form an ink aggregated layer. When the intermediate image then reached the heating device 105, a volatile component such as water content was removed by a drying treatment, and moreover the ink aggregated layer was heated. When the ink aggregated layer 32 forming the intermediate image reached the position of the heating roller 114 with the built-in heating unit 112, the ink aggregated layer was further heated to 120° C. which is a temperature equal to or higher than the minimum film forming temperature of the resin fine particle applied as the ink component, and the ink aggregated layer was formed into a film to become a colored film, and so the image was fixed. When the intermediate image in the heated state reached the intermediate transfer member cooling device 106, the intermediate image was cooled from the back side of the intermediate transfer member 101.

When the intermediate image further reached the position of the transfer roller 108, the intermediate image came into contact with a recording medium 107 retained at a temperature of 25° C., the colored film forming the intermediate image was further cooled to 60° C. which is a temperature lower than the glass transition temperature of the resin fine particle, and the temperature thereof was further lowered to 50° C. to transfer the intermediate image to the recording medium 107.

In this example, the timing of the heating and pressing to the ink aggregated layer is as described above with reference to FIG. 3.

In this example, the transfer is conducted at a stage in which the intermediate image reaches 60° C. which is a temperature lower than the glass transition temperature of the resin fine particle added as the ink component, whereby the form of an image surface is not deformed even when the transfer is conducted while applying a pressure to the recording medium 107, so that a high-gloss image can be obtained.

The 20-degree glossiness (JIS Z 8741) of the image obtained on the recording medium was 40 to 100, and the surface roughness (Ra) thereof was 0.1 μm or less. Incidentally, the measurement of the 20-degree glossiness can be conducted by means of a handy type gloss meter, PG-II/IIM (manufactured by Nippon Denshoku Industries Co., Ltd.).

Example 2

Use of Transfer Aid Liquid:

After respective components of the following formulation were mixed, and the resultant mixture was sufficiently stirred, the mixture was filtered under pressure through a microfilter (product of Fuji Photo Film Co., Ltd.) having a pore size of 3.0 μm to collect a filtrate as a transfer aid liquid.

Formulation of Transfer Aid Liquid:

Resin fine particle dispersion obtained in Preparation Example 1: 30%

Water-soluble resin (styrene-butyl acrylate-acrylic acid terpolymer (acid value: <132 mg KOH/g, weight-average molecular weight: 7,700, glass transition temperature: 78° C.>); solid content: 20%; neutralized with potassium hydroxide]: 3%

Glycerol: 5%

Diethylene glycol: 4%

Surfactant (Acetylenol EH; product of Kawaken Fine Chemicals Co, Ltd.): 1%

Ion-exchanged water: 57%.

In this example, a transfer-type ink jet recording apparatus of such a construction that a liquid ejection head 104 for ejecting the transfer aid liquid is added to the construction of Example 1 was provided.

As the liquid ejection head 104, a head of such a type that liquid ejection is conducted by an On-demand method using an electrothermal converter was used. As this liquid ejection head, was used a liquid ejection head of a line head form in which ejection orifices are arranged in a line in a direction substantially perpendicular to a conveying direction of the intermediate image forming surface of the intermediate transfer member was used.

Formation of a transferred image on a recording medium 107 was carried out under the same conditions as in Example 1 except that the transfer aid liquid was applied in an amount of 5 g/m$^2$ to 15 g/m$^2$ to the intermediate image formed by the ink jet recording head 103 on the intermediate transfer member 101 from the liquid ejection head 104, and the time required to apply the pressure to the ink aggregated layer upon the transfer was 10 msec.

The apparatus according to this example has such a construction that the transfer aid liquid applying unit is provided, whereby the transferability of the intermediate image to the recording medium is more improved. According to this example, the Ra of the transferred image finally obtained was 0.1 and so the same high-gloss image as in Example 1 was obtained.

Example 3

Selection Function of Printed Image Quality and Photographic Image Quality:

A transfer-type ink jet recording apparatus of the construction illustrated in FIGS. 5A and 5B was provided in the same manner as in Example 1 except that a transfer roller 109 with a built-in heating unit was added. Incidentally, a transfer roller 110 has the same function as the transfer roller 108 illustrated in FIG. 1.

The respective steps of the application of the reaction liquid, the recording of the intermediate image, the drying of the intermediate image and the film formation of the ink aggregated layer by heating the ink aggregated layer to the temperature not lower than the minimum film forming temperature of the resin fine particle added as the ink component were conducted in the same manner as in Example 1. Incidentally, the temperature for forming the ink aggregated layer into the film was 120° C.

A mode with which a transferred image which does not require high glossiness is obtained on the recording medium is selected to move the transfer roller 109 to a contact position with the intermediate transfer member 101, thereby transferring an intermediate image with the temperature of the colored film having passed through the heating roller 114 being higher than Tg of the resin particle added as the ink component to the recording medium 107. The transfer of the intermediate image was carried out under conditions in which the pressure applied to the intermediate image upon the transfer is 15 kg/cm$^2$, the time required to apply the pressure to the intermediate image is 900 msec, and the temperature of the intermediate image heated by the transfer roller 109 is 120° C.

A mode with which a transferred image which requires high glossiness is obtained on the recording medium is selected to separate the transfer roller 109 from the intermediate transfer member 101 and move the transfer roller 110 to a contact position with the intermediate transfer member 101. In this state, the transfer of the intermediate image was conducted at a temperature (60° C.) not higher than Tg of the resin particle added as the ink component in the same manner as in Example 1.

In this example, the surface roughness Ra of the intermediate transfer member 101 used was 0.02 μm, while the Ra of the transferred image finally obtained in the case where the transfer was conducted by the second transfer roller 109 was 0.54 μm, so that the image had low gloss. On the other hand, the Ra of the transferred image finally obtained in the case where the transfer was conducted by the first transfer roller 110 was 0.1 μm, so that the image had high gloss.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-125859, filed Jun. 23, 2015, which is hereby incorporated by reference herein in its entirety.

What is claimed is:

1. A transfer-type ink jet recording apparatus comprising an intermediate image forming unit for applying an ink containing a resin to an intermediate transfer member to form an intermediate image and a transfer unit for transferring the intermediate image to a recording medium, wherein the apparatus further comprises a heating unit for heating the intermediate image to a temperature equal to or higher than a minimum film forming temperature of the resin and a cooling unit for cooling the intermediate image heated by the heating unit to a temperature lower than a glass transition temperature of the resin to supply the image to the transfer unit.

2. The transfer-type ink jet recording apparatus according to claim 1, wherein a surface of the recording medium to which the intermediate image is transferred is subjected to a hydrophilization treatment.

3. The transfer-type ink jet recording apparatus according to claim 1, wherein a surface roughness Ra of an intermediate image forming surface of the intermediate transfer member is 0.1 μm or less.

4. The transfer-type ink jet recording apparatus according to claim 1, wherein the apparatus has a transfer unit for transferring the intermediate image cooled by the cooling unit as a first transfer unit, a transfer unit for transferring the intermediate image heated by the heating unit to the recording medium at a temperature not lower than the glass transition temperature of the resin contained in the ink as a second transfer unit, and a switching unit for selectably conducting switching to one of intermediate image transfer modes of the first transfer unit and the second transfer unit.

5. The transfer-type ink jet recording apparatus according to claim 1, further comprising a transfer aid liquid applying unit for applying a transfer aid liquid for improving transferability to the intermediate image.

6. The transfer-type ink jet recording apparatus according to claim 5, wherein the transfer aid liquid contains a resin.

7. The transfer-type ink jet recording apparatus according to claim 1, wherein the ink further contains a coloring material and a liquid medium.

8. The transfer-type ink jet recording apparatus according to claim 1, wherein the ink is an aqueous ink.

9. The transfer-type ink jet recording apparatus according to claim 1, wherein the apparatus has a reaction liquid applying unit for applying a reaction liquid for increasing the viscosity of the ink.

10. The transfer-type ink jet recording apparatus according to claim 1, wherein the intermediate image cooled by the cooling unit is brought into contact with the recording medium in a softened state.

* * * * *